US005467710A

United States Patent [19]

Wirz

[11] Patent Number: 5,467,710

[45] Date of Patent: Nov. 21, 1995

[54] ROTARY PRINTING PRESS FOR TWO-SIDED PRINTING OF SHEETS

[75] Inventor: Arno Wirz, Bammental, Germany

[73] Assignee: Heidelberger Druckmaschinen AG, Heidelberg, Germany

[21] Appl. No.: 195,156

[22] Filed: Feb. 10, 1994

[30] Foreign Application Priority Data

Feb. 10, 1993 [DE] Germany ..... 43 03 796.8

[51] Int. Cl.[6] ..... B41F 5/02; B41F 5/22

[52] U.S. Cl. ..... 101/177; 101/230

[58] Field of Search ..... 101/183, 184, 101/185, 136–145, 174, 175, 177, 216–218, 229, 230, 231

[56] References Cited

U.S. PATENT DOCUMENTS

| | | | |
|---|---|---|---|
| 1,635,299 | 7/1927 | Wohlrabe . | |
| 2,911,907 | 11/1959 | Davidson | 101/137 |
| 3,384,011 | 5/1968 | Bolza-Schünemann . | |
| 3,848,320 | 11/1974 | Davidson | 101/232 X |
| 4,774,883 | 10/1988 | Mailänder . | |
| 4,854,232 | 8/1989 | Oda | 101/177 |
| 4,960,049 | 10/1990 | Mimura et al. | 101/183 |
| 5,062,360 | 11/1991 | Germann et al. . | |
| 5,136,942 | 8/1992 | Germann . | |

FOREIGN PATENT DOCUMENTS

| | | |
|---|---|---|
| 0415881 | 3/1991 | European Pat. Off. . |
| 407369 | 1/1923 | Germany . |
| 443399 | 5/1925 | Germany . |
| 441329 | 5/1925 | Germany . |
| 1235953 | 3/1967 | Germany . |
| 3939432 | 6/1991 | Germany . |
| 716076 | 9/1954 | United Kingdom . |

*Primary Examiner*—J. Reed Fisher
*Attorney, Agent, or Firm*—Herbert L. Lerner; Laurence A. Greenberg

[57] ABSTRACT

Rotary printing press for two-sided printing of sheets having a first and a second printing unit, respectively including an impression cylinder, the press having a sheet feeder with a device for separating sheets singly from a feeder pile and a device for feeding the singly separated sheets to the first printing unit for printing one of the sides of the respective sheets, a device for conveying the sheets to the second printing unit for printing the other of the sides of the respective sheets and through the entire printing press, a delivery having a device for conveying and depositing the sheets on a delivery pile, and a control device for controlling operational sequences performed in the rotary printing press, the first and second printing units being satellite printing units disposed in tandem horizontally and, respectively, having a plurality of printing devices arranged around each of the respective impression cylinders thereof, the sheet feeder and the delivery being disposed between the first and second satellite printing units.

19 Claims, 1 Drawing Sheet

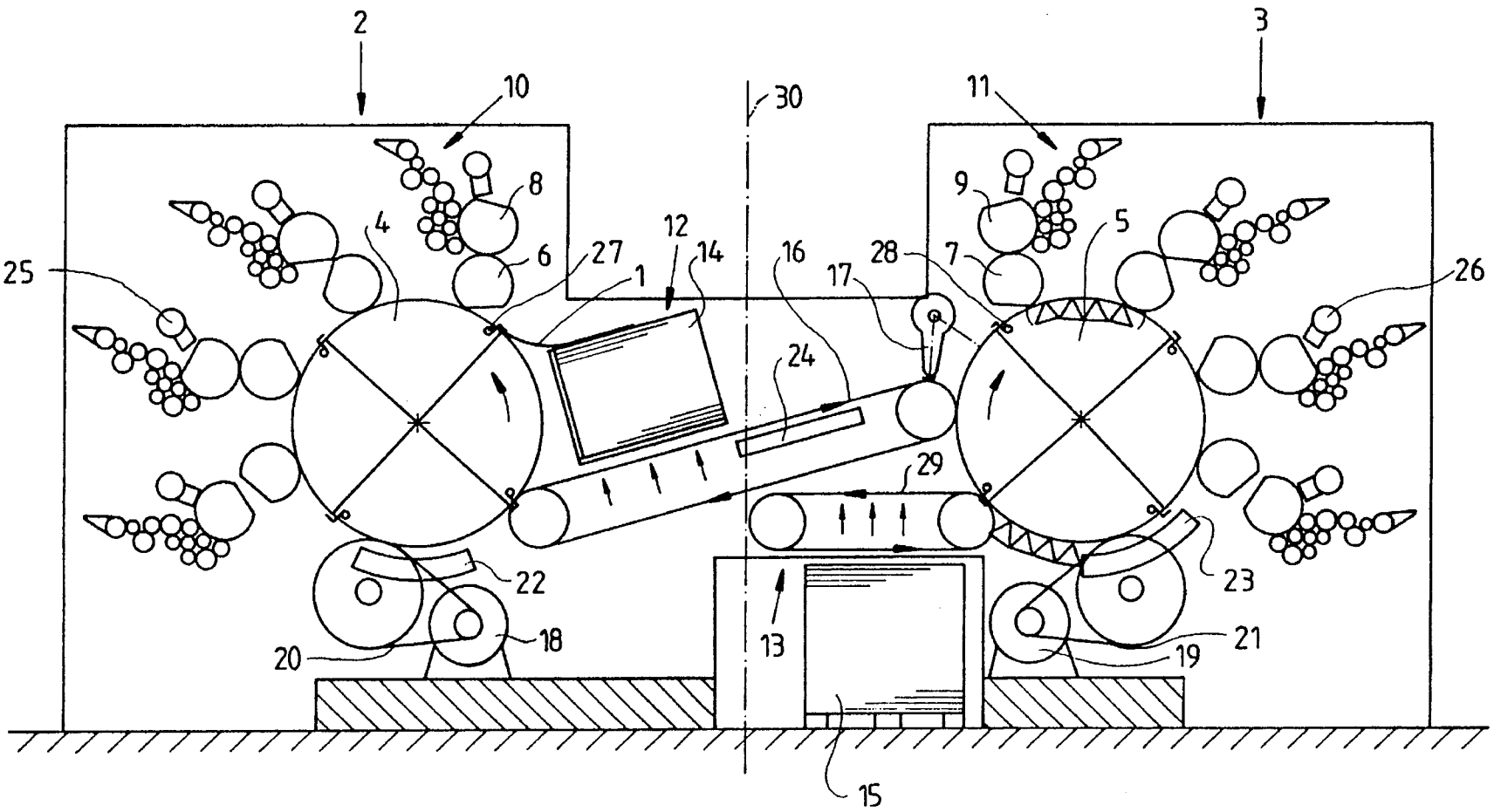
26
3
23
21
19
5
11
9
7
28
29
17
15
16
24
30
13
14
12
1
27
8
6
10
22
18
2
4
20
25

ROTARY PRINTING PRESS FOR TWO-SIDED PRINTING OF SHEETS

The invention relates to a perfector press for two-sided printing of sheets, wherein sheets are able to be printed on both sides thereof by multi-color printing in just one pass, no recto/verso-printing or first form/perfector changeover or conversion devices and no turning devices for the sheets being provided.

Such non-convertible perfector presses operate preponderantly in accordance with the so-called blanket-to-blanket principle. In such a case, a printing unit for offset printing is formed of two plates and two rubber-blanket cylinders, one of which serves as an impression cylinder for the other. When two-sided multicolor printing is provided, a plurality of printing units may be arranged in-line in accordance with the unit construction principle. A feeder is disposed before the first printing unit and a delivery is disposed after the last printing unit. In-line printing presses are voluminous, elaborate and costly.

In contrast therewith, satellite printing units for offset printing are of compact construction. By disposing more than two blanket-cylinder and plate-cylinder pairs about a common impression cylinder, the number of sheet-conveying cylinders and other devices is reduced with respect to printing presses having an in-line arrangement.

In conventional satellite presses, the number of blanket-cylinder and plate-cylinder pairs about an impression cylinder is limited to four for reasons of accessibility to the printing units, so that, in a satellite printing unit, a sheet can be printed with four colors on one side. (German Published Prosecuted Patent Application 12 35 953, German Patent 441 329, German Patent 443 399, and U.S. Pat. No. 4,936, 211)

German Published Prosecuted Patent Application 12 35 953 describes a sheet-fed rotary offset printing press of satellite construction for selective recto/verso, i.e., first form and perfector, printing and purely one-sided printing wherein, by varying the engagement of the blanket cylinders, two-color recto-and-verso printing, four-color single-sided printing or three-color recto printing and one-color verso printing are possible.

In none of the heretofore known satellite presses for printing sheets is four-color or more than four-color recto-and-verso, i.e., first form and perfector, printing in one pass provided. Only in the case of web-fed printing presses is it known for two satellite printing units to be disposed one above the other in a tower arrangement. The printing-unit tower disclosed in Published Non-prosecuted Patent Application DE 39 39 432 Al permits four-color recto-and-verso, i.e. first form and perfector, printing on web stock. Tower-type printing presses require comparatively high production rooms or spaces.

It is accordingly an object of the invention to provide a rotary printing press of satellite construction for two-sided printing of sheets, which permits the printing, in one pass, selectively of more than three colors on both sides of the sheets, the space requirement for the rotary printing press being as small as possible.

With the foregoing and other objects in view, there is provided, in accordance with the invention, a rotary printing press for two-sided printing of sheets having a first and a second printing unit, respectively including an impression cylinder, the press comprising a sheet feeder having means for separating sheets singly from a feeder pile and means for feeding the singly separated sheets to the first printing unit for printing one of the sides of the respective sheets, means for conveying the sheets to the second printing unit for printing the other of the sides of the respective sheets and through the entire printing press, a delivery having means for conveying and depositing the sheets on a delivery pile, and a control device for controlling operational sequences performed in the rotary printing press, the first and second printing units being satellite printing units disposed in tandem horizontally and, respectively, having a plurality of printing devices arranged around each of the respective impression cylinders thereof, the sheet feeder and the delivery being disposed between the first and second satellite printing units.

The printing device according to the invention offers a compact construction, is economical to manufacture and is very versatile in use for good-quality printing.

In accordance with another feature of the invention, the impression cylinders are disposed axially parallel in a common horizontal plane.

In accordance with a further feature of the invention, the feeder pile and the delivery pile have respective top sides situated, respectively, above and below the horizontal plane, thereby providing for a relatively compact form of construction of the printing press.

In accordance with an added feature of the invention, the sheets are conveyable by the conveying means in a given transport direction, and the delivery pile is removable sidewise transversely to the given transport direction of the sheets.

In accordance with an additional feature of the invention, the printing means comprise a plurality of printing devices which are individually disengageable from one another and from the respective impression cylinders, so that the number of colors used for printing is variable.

In accordance with yet another feature of the invention, the first and second satellite printing units are arranged symmetrically with respect to a vertical plane located between the satellite printing units.

In accordance with yet a further feature of the invention, the rotary printing press includes means for driving the impression cylinders in synchronism.

In accordance with yet an added feature of the invention, the driving means include a gear transmission coupled with the respective impression cylinders.

In accordance with an alternative feature of the invention, the the impression cylinders are mechanically decoupled from one another, and the driving means include respective motors connected to the control device for controlling the synchronism between the impression cylinders.

In accordance with still another feature of the invention, the plurality of printing devices arranged around each of the respective impression cylinders is four in number.

In accordance with still a further feature of the invention, the plurality of printing devices arranged around each of the respective impression cylinders includes a blanket cylinder and a plate cylinder for offset printing.

In accordance with still an added feature of the invention, the rotary printing press includes a device operatively associated with the respective plate cylinder for producing a printing form disposed on the plate cylinder, the printing-form producing device having an input device for receiving digitized image data.

In accordance with still an additional feature of the invention, the input device is operatively associated with the control device.

In accordance with another feature of the invention and for attaining a high print quality, the impression cylinder of the second printing unit is formed with a printing ink-repellent surface.

In accordance with a further feature of the invention and also for attaining high print quality, the rotary printing press includes a respective treating device disposed downline from a last one of the plurality of printing devices of the respective first and second satellite printing units for treating the respective printed surface of the sheet.

In accordance with an added feature of the invention, the treating device is disconnectible.

In accordance with an additional feature of the invention, the treating device includes at least one of a dryer, a cooling device and a powder-coating device.

In accordance with yet another feature of the invention, the means for conveying the sheets to the second printing unit from the first printing unit is a chain-type gripper system having a transfer gripper downstream therefrom.

In accordance with a concomitant feature of the invention, the sheets are conveyable by the conveying means along a given conveying path for the sheets from the impression cylinder of the first printing unit to the impression cylinder of the second printing unit, and a dryer is disposed in the given conveying path for drying the printing ink on the one printed side of the respective sheets.

Other features which are considered as characteristic for the invention are set forth in the appended claims.

Although the invention is illustrated and described herein as embodied in a rotary printing press for two-sided printing of sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single figure of the drawing which is a diagrammatic side elevational view of a rotary printing press for two-sided printing of sheets, which is constructed in accordance with the invention.

The single FIGURE of the drawing shows an elevational view of the invention, having two connected printing units.

Referring now to the drawing FIGURE, there is shown therein an exemplary embodiment of the rotary printing press according to the invention which prints on both sides of sheets 1. The illustrated rotary printing press can operate as an eight-color—4/4 —perfector press. More specifically, the printing press is formed of two satellite printing units 2 and 3, each with a respective impression cylinder 4, 5 around which, respectively, four pairs of blanket cylinders 6, 7 and plate cylinders 8, 9 are disposed. A respective inking unit 10, 11 is associated with each plate/blanket-cylinder pair 6, 8 and 7, 9, respectively. A sheet feeder 12 and a delivery 13 are disposed between the satellite printing units 2 and 3. The feeder pile 14 and the delivery pile 15 have respective upper sides which are situated, respectively, above and below a horizontal plane in which respective axes of the impression cylinders 4 and 5 are disposed. A chain-type gripper system 16 With a succeeding transfer gripper 17 is provided for conveying the sheets 1 from the first satellite printing unit 2 to the second satellite printing unit 3. Each of the satellite printing units 2 and 3, respectively, is driven by its own motor 18, 19 and a respective transmission 20, 21. Disposed on each of the impression cylinders 4 and 5, respectively, downline from the last plate-cylinder/blanket-cylinder pair 6,8 and 7,9, is a respective dryer 22, 23 for the printing ink. A further dryer 24 is situated between the top and bottom sides of the chain-type gripper system 16. Respective texturing or structuring units 25 and 26 are provided for producing printing forms disposed on the plate cylinders 8 and 9, the texturing or structuring units 25 and 26 being suppliable with digital data. A non-illustrated control unit is provided for the entire rotary printing press for the purpose of controlling the respective motors 18 and 19 of the texturing or structuring units 25 and 26 of the respective dryers 22, 23 and 24, as well as all of the other actuating and measuring elements.

A sheet 1 is separated individually or singled from the feeder pile 14 and is fed to one of four gripper systems 27 of the impression cylinder 4. The plate-cylinder/blanket-cylinder pairs 6, 8 and the dryer 22 are disposed around the impression cylinder 4 which has a diameter quadruple the length of the diameter of either the plate or the-blanket cylinder 6, 8, so that, during one revolution of the impression cylinder 4, a first one of the sheets 1 is gripped by the gripper system 27, two further sheets 1 are each printed by means of two plate-/blanket-cylinder pairs 6, 8 and a fourth sheet 1 is dried. The sheets 1 printed by the satellite printing unit 2 are conveyed on the top side of the chain-type gripper system 16 to the second satellite printing unit 3 and are simultaneously further dried by the dryer 24. By means of the transfer gripper 17, the sheets 1 are transferred from the chain-type gripper system 16 to one of four gripper systems 28 of the second impression cylinder 5. The sheets 1, with the respective sides thereof which had first been printed in the printing unit 2 now lying on the impression cylinder 5, are printed on the respective opposite sides thereof in the second satellite printing unit 3. The impression cylinder 5 has a printing ink-repellent surface. The printing operation on the second impression cylinder 5 occurs in a manner similar to that on the first impression cylinder 4. For this purpose, the satellite printing units 2 and 3 are disposed symmetrically with respect to a plane 30 represented by a phantom line. After the sheets 1 have been dried by the dryer 23, they are deposited on the delivery pile 15 by means of a chain-type gripper system 29. The delivery pile 15 may be removed sidewise transversely with respect to the transport direction of the sheets 1 or may be subjected to further processing. The plate-cylinder/blanket-cylinder pairs 6, 8 and 7, 9 may be brought individually into engagement with and out of engagement from the respective impression cylinders 4 and 5, so that, if required, each side of the respective sheets 1 may also selectively be printed with less than four colors.

I claim:

1. Rotary printing press for two-sided printing of sheets having a first and a second printing unit, each comprising a respective impression cylinder, the press having a sheet feeder, having means for separating sheets singly from a feeder pile, and means for feeding the singly separated sheets to the first printing unit for printing one of the sides of the respective sheets; means for conveying the sheets to the second printing unit for printing the other of the sides of the respective sheets and through the entire printing press; a delivery having means for conveying and depositing the sheets on a delivery pile, and a control device for controlling operating sequences performed in the rotary printing press; the first and second printing unit being disposed in tandem horizontally and, respectively having a plurality of inking units arranged around each of the respective impression cylinder; said sheet feeder and said delivery being disposed between the first and second printing unit.

2. Rotary printing press according to claim 1, wherein the impression cylinders are disposed axially parallel in a common horizontal plane.

3. Rotary printing press according to claim 2, wherein the feeder pile and the delivery pile have respective top sides situated, respectively, above and below said horizontal plane.

4. Rotary printing press according to claim 1, wherein the sheets are conveyable by said conveying means in a given transport direction, and said delivery pile is removable transversely to said given transport direction of the sheets.

5. Rotary printing press according to claim 1, wherein said printing means comprise a plurality of inking units which are disengageable from one another and from the respective impression cylinders.

6. Rotary printing press according to claim 1, including means for driving the impression cylinders in synchronism.

7. Rotary printing press according to claim 6, wherein said driving means include a gear transmission coupled with the respective impression cylinders.

8. Rotary printing press according to claim 6, wherein the impression cylinders are mechanically decoupled from one another, and said driving means include respective motors connected to said control device, and synchronizing means connected with said motors for synchronizing the impression cylinders.

9. Rotary printing press according to claim 1, wherein said plurality of inking units arranged around each of the respective impression cylinders is four in number.

10. Rotary printing press according to claim 1, wherein said plurality of inking units arranged around each of the respective impression cylinders includes a blanket cylinder and a plate cylinder for offset printing.

11. Rotary printing press according to claim 10, including a printing-form producing device in operative engagement with a respective plate cylinder for producing a printing form disposed on the plate cylinder, said printing-form producing device having an input device for receiving digitized image data.

12. Rotary printing press according to claim 11, wherein said input device is in operative engagement with said control device.

13. Rotary printing press according to claim 1, including a printing ink-repellent surface on said impression cylinder.

14. Rotary printing press according to claim 1, including a respective treating device disposed downline from a last one of said plurality of inking units of the respective first and second printing units for treating the respective printed surface of the sheet.

15. Rotary printing press according to claim 14, wherein said treating device is disconnectible.

16. Rotary printing press according to claim 14, wherein said treating device includes at least one of a dryer, a cooling device and a powder-coating device.

17. Rotary printing press according to claim 1, wherein said means for conveying the sheets to the second printing unit from the first printing unit, is a chain-type gripper system having a transfer gripper downstream therefrom.

18. Rotary printing press according to claim 17, wherein the sheets are conveyable by said conveying means along a given conveying path for the sheets from the impression cylinder of the first printing unit to the impression cylinder of the second printing unit, and including a dryer disposed in said given conveying path for drying the printing ink on the one printed side of the respective sheets.

19. Rotary printing press according to claim 17, wherein the first and second satellite printing units are arranged symmetrically with respect to a vertical plane located between the satellite printing units.

* * * * *